US007530209B2

(12) United States Patent
Spiers et al.

(10) Patent No.: US 7,530,209 B2
(45) Date of Patent: May 12, 2009

(54) COUPON POSITIONING AND ROTATION WHEEL

(75) Inventors: Steven F. Spiers, Richmond, VA (US); Steven M. Campbell, Mechanicsville, VA (US); G. Robert Scott, Midlothian, VA (US)

(73) Assignee: Philip Morris USA Inc., Richmond, WA (US)

( * ) Notice: Subject to any disclaimer, the term of this patent is extended or adjusted under 35 U.S.C. 154(b) by 0 days.

(21) Appl. No.: 11/831,336

(22) Filed: Jul. 31, 2007

(65) Prior Publication Data

US 2008/0072533 A1 Mar. 27, 2008

Related U.S. Application Data

(60) Provisional application No. 60/826,638, filed on Sep. 22, 2006.

(51) Int. Cl.
*B31B 1/80* (2006.01)

(52) U.S. Cl. ..... 53/244; 493/315

(58) Field of Classification Search ..... 53/415, 53/244, 381.1; 493/315
See application file for complete search history.

(56) References Cited

U.S. PATENT DOCUMENTS

| | | | | |
|---|---|---|---|---|
| 3,695,422 | A | 10/1972 | Tripodi | |
| 4,125,254 | A | 11/1978 | Boyer | |
| 4,211,153 | A * | 7/1980 | Walters et al. | 493/310 |
| 4,460,349 | A * | 7/1984 | Charron | 493/163 |
| 4,548,668 | A * | 10/1985 | Roth et al. | 156/357 |
| 5,000,433 | A * | 3/1991 | Prum et al. | 270/49 |
| 5,102,385 | A * | 4/1992 | Calvert | 493/315 |
| 5,176,612 | A * | 1/1993 | Calvert et al. | 493/315 |
| 5,215,515 | A | 6/1993 | Bershadsky | |
| 5,250,134 | A | 10/1993 | Thomas et al. | |
| 5,511,772 | A * | 4/1996 | Ganz et al. | 271/12 |
| 5,664,400 | A * | 9/1997 | Drury et al. | 53/381.1 |
| 5,704,195 | A * | 1/1998 | Benz | 53/444 |
| 5,732,536 | A * | 3/1998 | Lin et al. | 53/535 |
| 5,826,870 | A * | 10/1998 | Vulgamore et al. | 271/1 |
| 6,105,340 | A | 8/2000 | Draghetti | |
| 6,129,814 | A | 10/2000 | Ballestrazzi et al. | |
| 6,213,286 | B1 * | 4/2001 | Hunter et al. | 198/471.1 |
| 6,427,423 | B1 | 8/2002 | Hinzman et al. | |
| 6,467,614 | B1 | 10/2002 | Tallier et al. | |
| 6,557,845 | B2 * | 5/2003 | Kaya et al. | 271/90 |
| 6,681,927 | B2 | 1/2004 | Focke et al. | |
| 6,684,606 | B1 | 2/2004 | Draghetti et al. | |
| 6,742,652 | B1 | 6/2004 | Focke et al. | |
| 7,252,131 | B2 | 8/2007 | Draghetti et al. | |
| 2002/0101026 | A1 * | 8/2002 | Kaya et al. | 271/100 |
| 2004/0194430 | A1 | 10/2004 | Draghetti et al. | |
| 2004/0242393 | A1 | 12/2004 | Cadieux et al. | |
| 2005/0035323 | A1 * | 2/2005 | Hunter et al. | 251/304 |

FOREIGN PATENT DOCUMENTS

| | | |
|---|---|---|
| EP | 0897871 | 2/1999 |
| EP | 1264770 | 12/2002 |

* cited by examiner

*Primary Examiner*—Rinaldi I. Rada
*Assistant Examiner*—Gloria R. Weeks
(74) *Attorney, Agent, or Firm*—Connolly Bove Lodge & Hutz LLP

(57) ABSTRACT

The present invention relates to apparatus and processes for accurately positioning and rotating coupons for application on cigarette packs or pack film.

13 Claims, 6 Drawing Sheets

COUPON POSITIONING AND ROTATION WHEEL

CROSS REFERENCE TO RELATED APPLICATION

The present application claims the benefit of provisional application Ser. No. 60/826,638, filed Sep. 22, 2006, for all useful purposes, and the specification and drawings thereof are included herein by reference.

FIELD OF THE INVENTION

The present invention relates to a device that will accurately position and rotate coupons for application on cigarette packs or pack film.

BACKGROUND OF THE INVENTION

The prior art provides separate mechanisms for positioning coupons, such as onserts or inserts, and rotating those coupons. For example, U.S. Patent Application Publication 2004/0242393, which is hereby incorporated by reference for all useful purposes, discloses a machine for folding and applying onserts onto consumer goods such as cigarette packs. The machine comprises a continuous roll of preprinted onserts and a transverse cutter assembly for cutting onsert segments from the continuous roll. Each onsert segment includes a pair of side-by-side preprinted onserts. A buckle folder receives each cut onsert segment and folds that segment along at least one transverse fold line. A longitudinal cutter assembly longitudinally cuts each folded onsert segment into two individual onserts. A transport system serially receives the individual folded onserts and moves the onserts along dual diverging paths where a pair of spaced apart lug belt conveyors receives the onserts from the discharge end of the transport system. Each lug belt conveyor includes spaced apart transverse lugs along the length thereof against which the onserts are positioned. A pair of spaced apart applicator wheels transfers the onserts from the conveyors onto spaced apart consumer goods traveling past the applicator wheels.

It is noteworthy that buckle folders are known in the art for producing folds in paper goods that operate by stopping the forward end of a paper substrate while continuing to move the remainder of the substrate thereby causing it to buckle downwardly into a roller nip which produces the fold. Mechanisms of this general type are described in U.S. Pat. No. 4,125,254, which is incorporated herein by reference for all useful purposes.

The operations of positioning and rotating coupons have never been combined into one mechanism for applying coupons to cigarette packs or pack film. It is therefore an objective of the invention to provide a machine that accurately positions and rotates a coupon on a single processing mechanism.

SUMMARY OF THE INVENTION

To accomplish these and other objectives, this invention provides a machine that accurately positions and rotates a coupon on a single processing wheel. As a result, the invention saves space and eliminates problems with transferring coupons between a positioning mechanism and a rotating mechanism.

BRIEF DESCRIPTION OF THE DRAWINGS

Novel features and advantages of the present invention in addition to those noted above will become apparent to persons of ordinary skill in the art from a reading of the following detailed description in conjunction with the accompanying drawings wherein similar reference characters refer to similar parts and in which.

DETAILED DESCRIPTION OF A PREFERRED EMBODIMENT

Embodiments of the invention will now be described in more detail with reference to the drawings. Generally speaking, the positioning and rotation wheel assembly according to the present invention can pick up coupons from a coupon delivery device, rotate them, apply glue to them if desired, and deliver them to cigarette pack overwrap, directly to cigarette packs or to a coupon reservoir. The wheel assemblies shown in FIGS. 1 through 4 may achieve this result. Coupons, as referred to herein, may include any informational or promotional insert or onsert as is known in the art of cigarette packaging and/or marketing.

Figure 1:
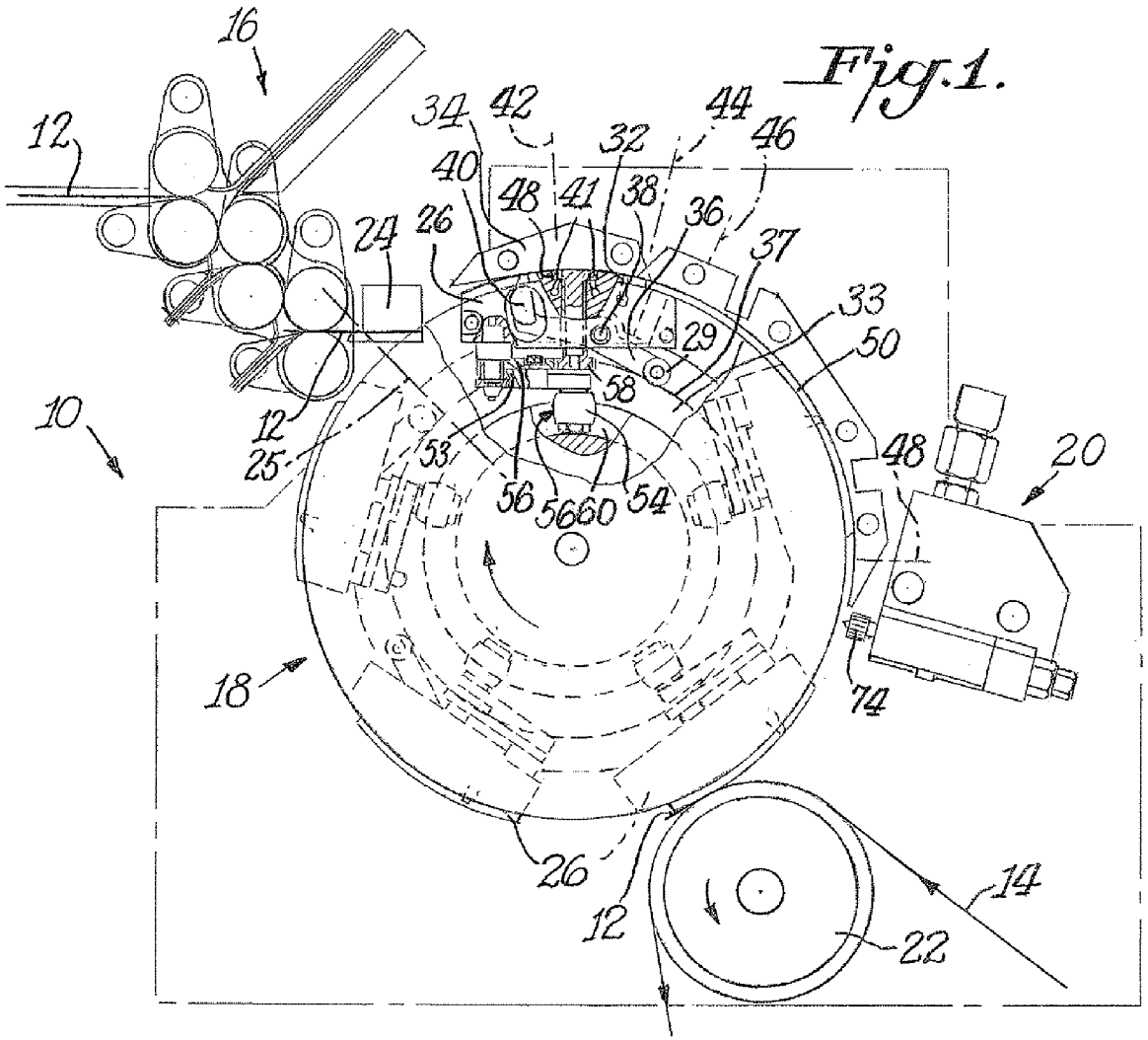
FIG. 1 is a side elevational view of a machine assembly for applying a coupon to overwrap for a cigarette pack.

As particularly shown in FIG. 1, the wheel assembly 18 may have five cam-operated gearbox inserts, or coupon carriers 26, that position and rotate coupons 12. The outer diameter of the wheel 18 and the number of coupon carriers may be determined by the desired coupon, or pack, spacing or by the amount of space available for this portion of the packaging process. FIGS. 5 through 8 show enlarged views of an individual coupon carrier 26 and will be described in greater detail below.

According to one embodiment of the invention, as shown in FIG. 1, a machine assembly 10 can be used to apply coupons 12 to cigarette pack overwrap film 14. Machine assembly 10 may include a means for providing and, in some instances, folding coupons 12, such as a conventional coupon buckle folder 16, described above. Machine assembly 10 may also include a rotation wheel 18 for moving and rotating coupons 12 into alignment for attachment to overwrap 14, a conventional adhesive applicator 20, and an overwrap wheel 22 that provides overwrap material 14 in proximity to the coupons on the rotation wheel so that the coupons 12 can be transferred thereto.

Figure 9:
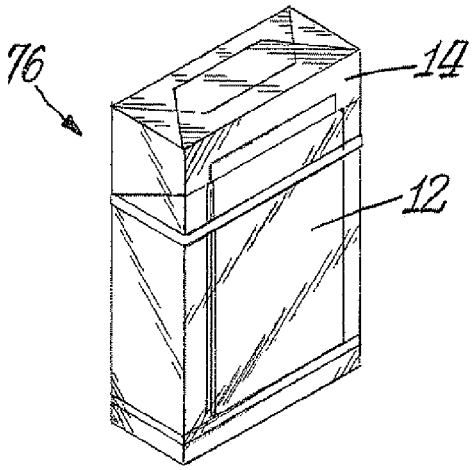
FIG. 9 is a perspective view showing a coupon attached to an overwrapped cigarette.
Figure 11:
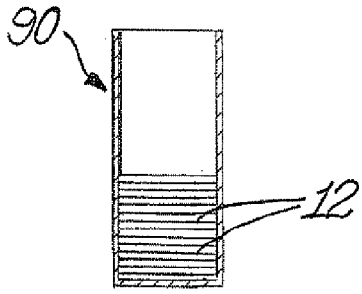
FIG. 11 is a front elevational view, in cross-section, of the coupons in a coupon reservoir magazine.
Figure 10:
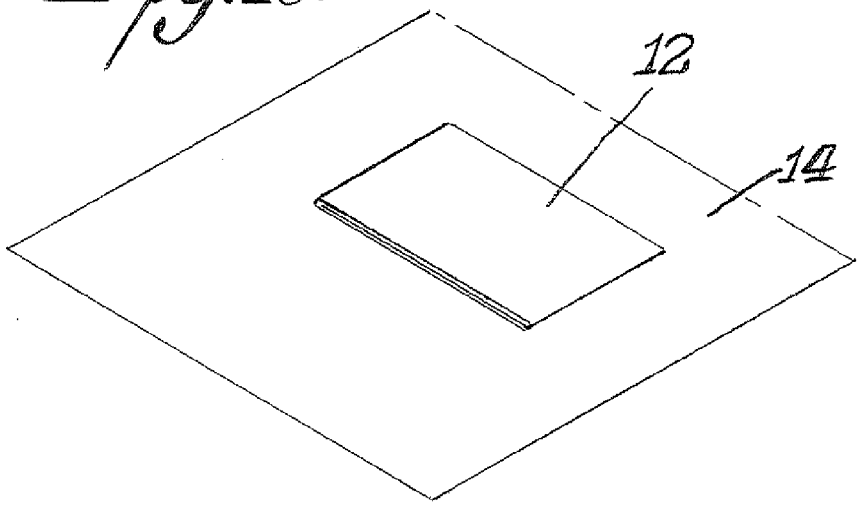
FIG. 10 is a perspective view showing a coupon attached to cigarette pack overwrapping.

More particularly, FIG. 1 shows coupon material 12, which may be single or multiple layered, being delivered single file from a coupon delivery device, such as a buckle folder 16, to a coupon delivery plate 24. Upon exiting the buckle folder 16, the folded coupon 12 is delivered to an applicator 18 in the form of a drum, or wheel 18, which rotates the coupons 12 and applies them onto a stream of wrap material 14, cigarette packs 76 or stores them in a magazine 80. The products formed by this process are shown in FIGS. 9-11.

Coupon material 12 may be folded, cut, and/or glued in the coupon folder 16 and then presented at the coupon delivery plate 24 for transfer to the positioning and rotation wheel 18. As wheel 18 rotates, coupon carrier 26 revolves about the central axis of wheel 18. When coupon carrier 26 passes through line 25 and approaches a folded coupon 12 on the delivery plate 24, a stationary vacuum manifold 28, shown in FIG. 4, supplies vacuum to the pickup suction port 32 of coupon carrier 26. For the sake of simplicity, the vacuum manifold is not shown in FIG. 1. The vacuum is provided from a vacuum source through manifold 28, shafts 30 and to pickup suction ports 32, shown in FIGS. 4 and 6, which pull coupon 12 onto coupon carrier 26.

Once coupon 12 is on coupon carrier 26, wheel 18 continues to rotate in the clockwise direction shown in FIG. 1. As the wheel 18 rotates, a cam follower 29 follows along a plate cam 33. The cam follower 29 is maintained along the outside edge 37 of the plate cam 33 through the use of a compressed spring 39, shown in FIG. 6, which forces a positioning arm 36 to rotate about axle 38. As the coupon carrier 26 approaches vacuum cowl 34, cam follower 29 follows a path along plate cam 33 that pivots positioning arm 36 about axle 38 to thereby raise one or more positioning fingers 40 behind the coupon 12. Preferably, at least two fingers 40 are used to position the coupon 12. As the coupon 12 travels under vacuum cowl 34, the vacuum at suction ports 32 are released. This event occurs approximately at the point that the coupon carrier 26 begins to cross line 42 and allows coupon 12 to begin to reposition relative to the positioning fingers 40.

One or more vacuums provided through ports (not shown) in the concave surface of the vacuum cowl 34 are engaged at the approximate point that coupon carrier 26 begins to cross line 44. The vacuum slows the coupon 12 and allows the leading edges of positioning fingers 40 to contact the rear edge of the coupon 12. This action aligns coupon 12 with fingers 40 and accurately controls the position of coupon 12 for application to film 14. Side guides 100 can also be attached to vacuum cowl 34 to control the position of the coupon relative the sides of coupon carrier 26.

Once coupon 12 is aligned with respect to coupon carrier 26, it is pushed under the rotation cowl 34 by the leading edges of positioning fingers 40. Vacuum is then applied to the rotation vacuum ports 41 shown in FIGS. 5 and 6 in the coupon 26 at approximately the point at which coupon carrier 26 begins to cross line 46. This vacuum pulls the coupon 12 against the surface of the rotating suction head 48. As cam follower 28 continues to travel along the edge of plate cam 33, cam 28 is urged away from the central axis of wheel 18 to recess the positioning fingers 40 by pivoting positioning arm 36 about axis 38 to force positioning fingers 40 below the top surface 50 of the coupon 26. This recessing action can be observed by comparing the position of fingers 40 in FIG. 5 to their position in FIG. 8.

Figure 7:
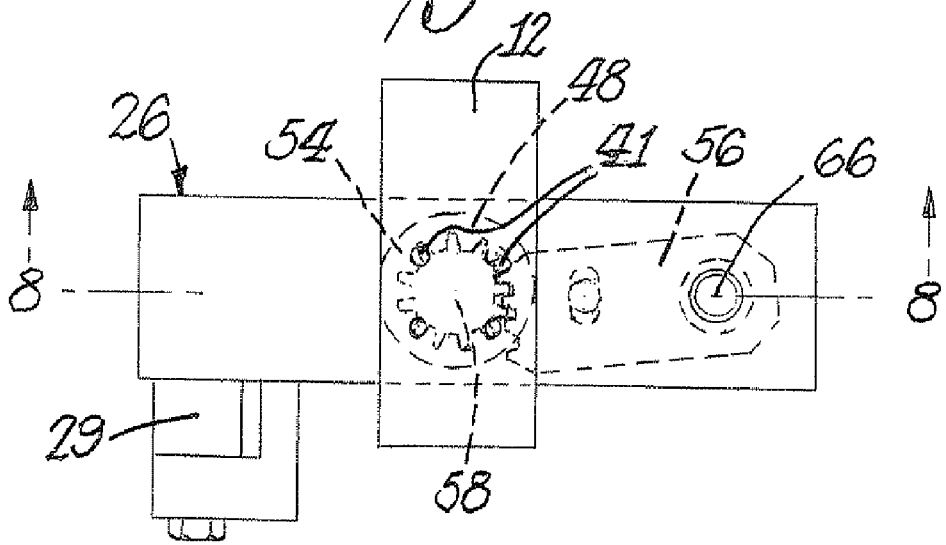
FIG. 7 is a top plan view of the coupon carrier showing the coupon rotated 90° for applying it to overwrap, cigarette pack, or reservoir.
Figure 8:
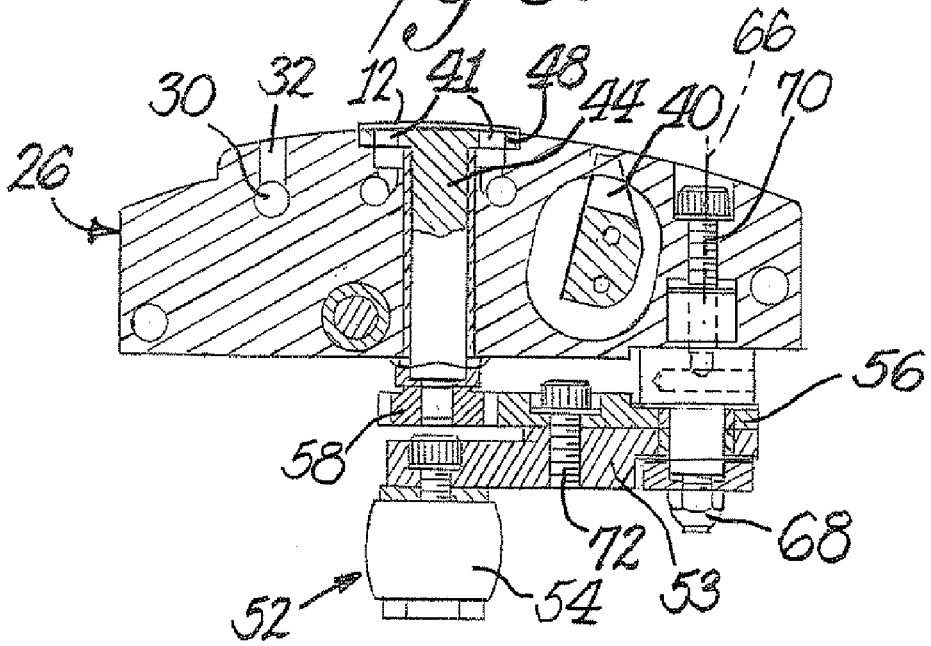
FIG. 8 is a cross-sectional view in elevation taken along line 8-8 of FIG. 7.

Once fingers 40 are recessed within the body of coupon 26, a barrel cam follower 54, rotates the rack gear 56 and pinion gear 58 through the use of a cam follower 54 attached to pivot arm 53. Cam follower 54 travels along a cam guide 60 on cam plate 33, shown in FIGS. 1 and 4. As particularly shown in the cross-section in FIG. 4, cam follower 54 is bounded by cam guide 60, which has two opposing sides that retain the cam follower 54. As cam follower 54 moves with wheel 18 it follows track 60, but also oscillates back and forth relative to the axis of wheel 18 due to the fact that the track diverts the cam follower 54 from a lower point 60*a* to a higher point 60*b* relative to the axis of wheel 18. Thus, as wheel 18 rotates, cam follower 54 tracks along the cam guide 60 pivoting a pivoting arm 53 about a pivoting axis 66 that is created by the nut 68 and bolt 70, which also serve to attach the barrel cam mechanism 52 to the coupon carrier 28. As shown in FIG. 8, another bolt 72 secures the rack gear 56 to cam arm 53. Rack gear 56 oscillates to rotate pinion gear 58 through an approximate 90° back and forth rotation. Thus, the coupon which was initially aligned with fingers 40 is rotated approximately 90° as shown in FIG. 7.

Returning to FIG. 1, as the coupon leaves the rotation cowl, it has been accurately positioned and rotated. Glue can then be applied, if desired, to the outer surface of coupon 12 using a gluing mechanism 20, which may include an applicator tip or spray head 74, as is well known in the art. A sensor may be used to detect the presence of the coupon and trigger the glue mechanism 20 to apply a predetermined amount of glue to the coupon.

As coupon 12 meets film 14, vacuum to the coupon carrier 26 is turned off and coupon 12 transfers to the film 14 where it is held in place by the glue applied with the glue mechanism 20, by gravity, or by any other force or means. The coupon and film, shown for example in FIG. 10, are then transferred for further processing as is conventional in the art. For example, the coupon 12 and film 14 may be wrapped and sealed around a cigarette pack with the coupon 12 on the inside of the wrapped film 14 as shown in FIG. 9. Film 14 could alternatively be wrapped such that the coupon 12 is on the outside of the wrapped pack 76.

Figure 2:
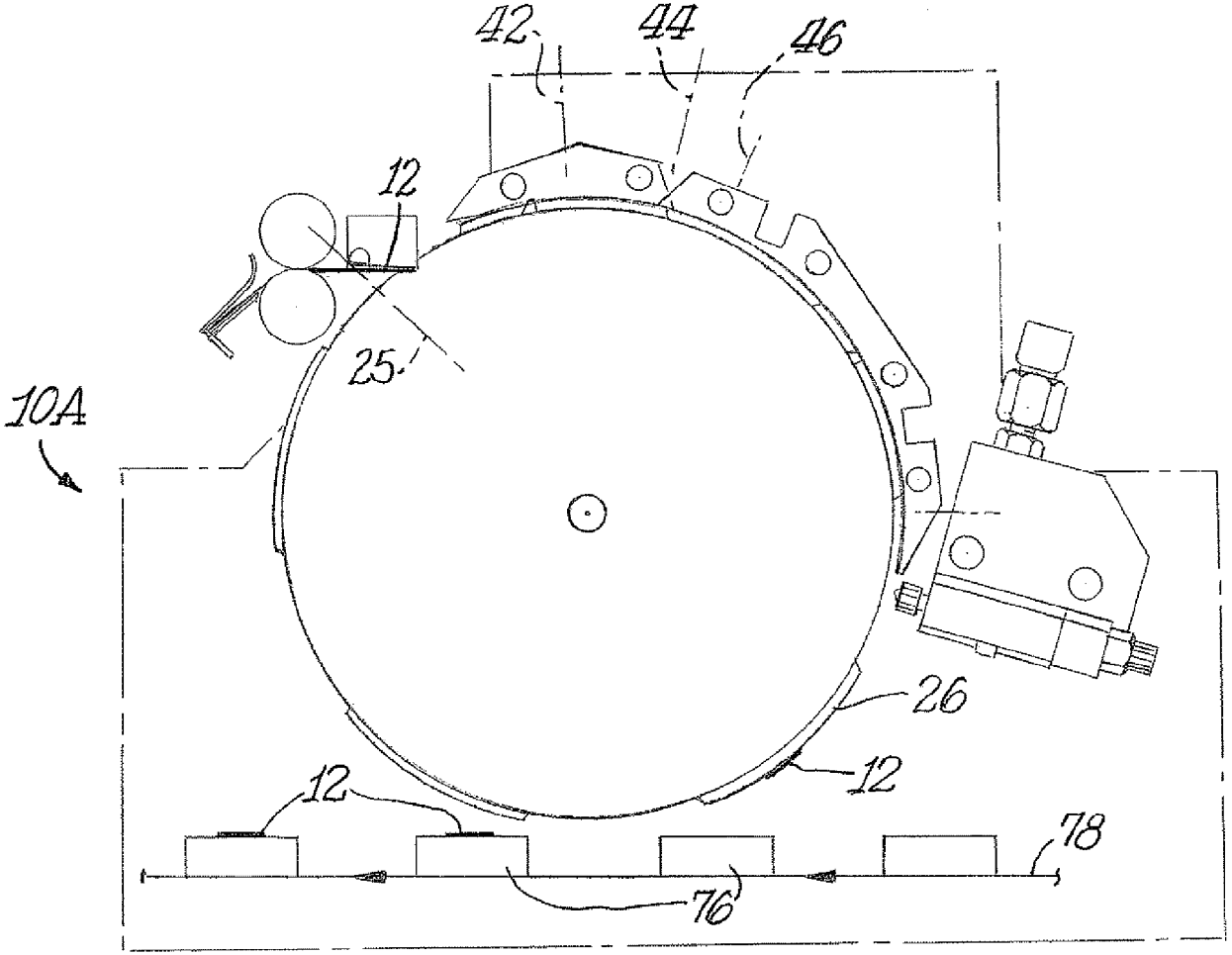
FIG. 2 is a side elevational view of a machine assembly for applying a coupon to a cigarette pack.
Figure 4:
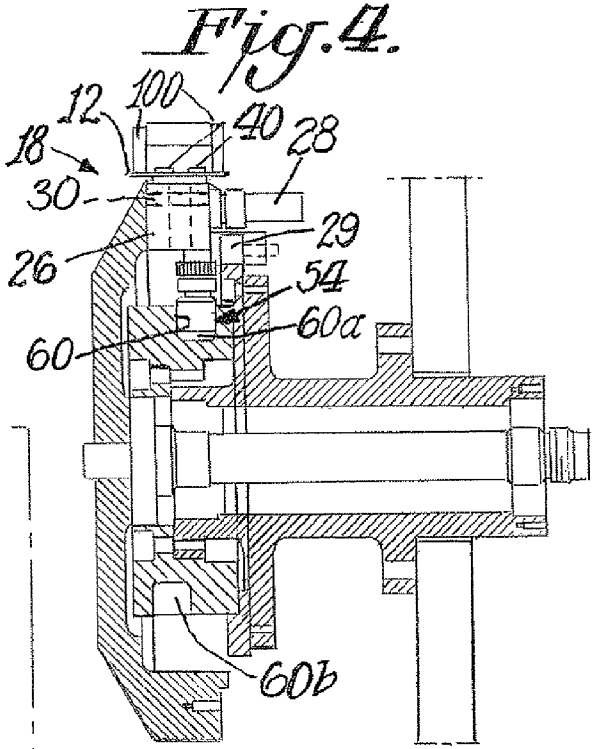
FIG. 4 is a cross-sectional view in elevation.

According to a second embodiment, the machine 10A may be configured to apply coupons to a cigarette pack 76, as shown in FIG. 2. The coupons are adjusted and rotated in a manner similar to that described above with regard to FIG. 1, except that rather than the coupons 12 being transferred to film 14, they are transferred to cigarette packs 76. The packs may be supplied by a conveyor belt 78 or other suitable means that may move at a predetermined speed and/or have a predetermined spacing between adjacent packs 76 so that the applicable surface of each pack 76 will align with a coupon 12 on coupon carrier 26. Packs 76 may be oriented in any predetermined manner. For example, the front, back, sides, top, or bottom of the packs 76 may be oriented facing toward coupon carrier 26 so that coupon 12 may be deposited thereupon.

Figure 3:
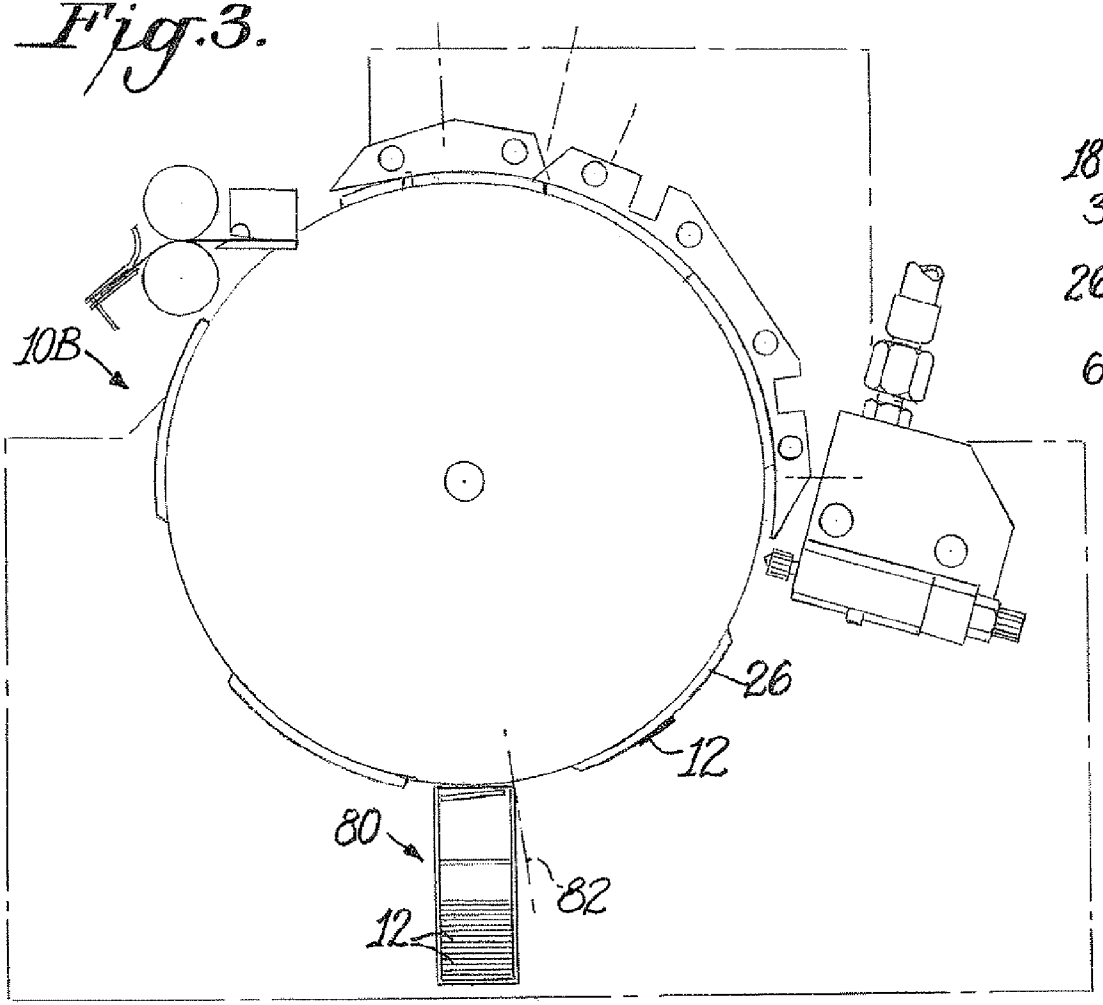
FIG. 3 is a side elevational view of a machine assembly for applying a coupon to a coupon reservoir magazine.
Figure 6:
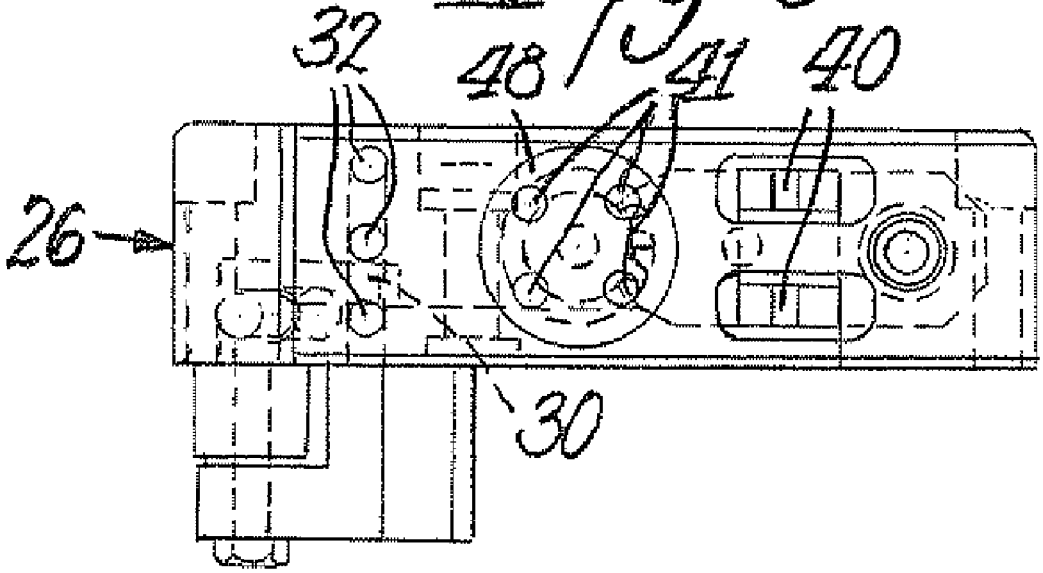
FIG. 6 is a top plan view of the coupon carrier shown in FIG. 5.
Figure 5:
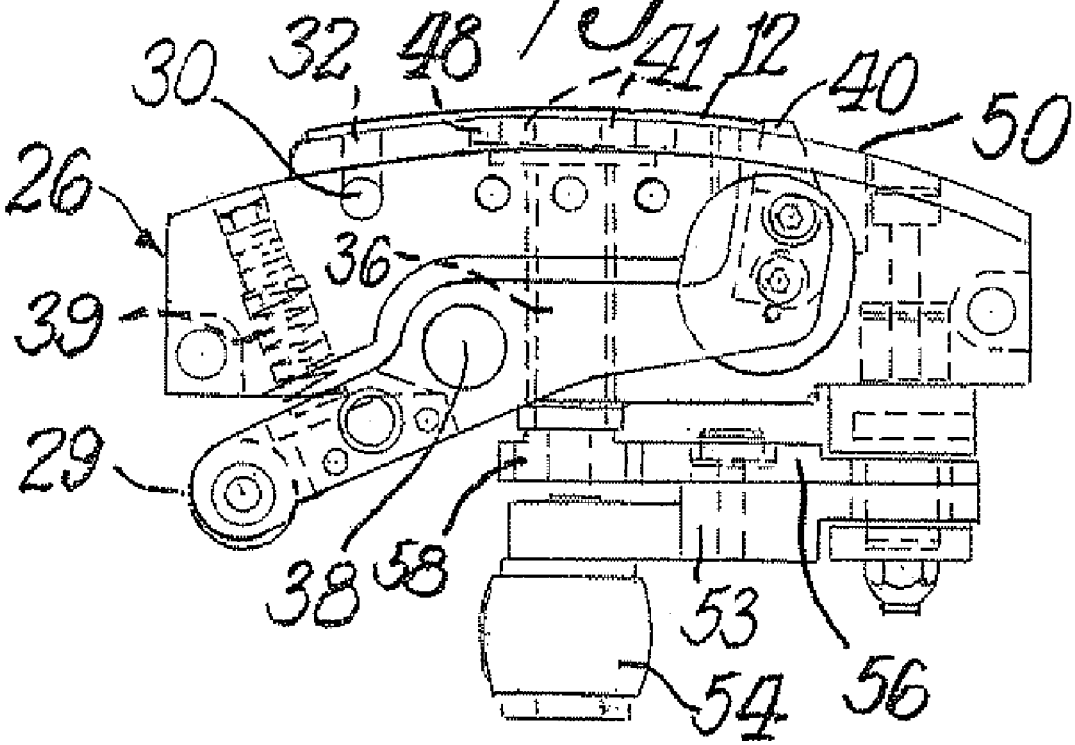
FIG. 5 is a side elevational view of a coupon carrier according to the present invention.

According to a third embodiment, the coupon rotating and positioning machine 10B may be adapted to supply coupons 12 to a coupon reservoir 80 as shown in FIG. 3. The coupons 12 are adjusted and rotated in a manner similar to that described above with regard to FIG. 1, except that rather than the coupons 12 being transferred to film 14, they are transferred to a coupon reservoir 80. According to this embodiment, no glue is applied to the coupons. The coupons 12 are positioned and rotated on coupon carrier 26 and carried under vacuum until they rotate through the point marked by phantom line 82. At that point, the vacuum is turned off such that coupons drop in to reservoir 80. When the magazine is full, it may be manually or automatically removed from its position for accepting coupons 12 to a storage facility or to another processing position where it may be used to provide coupons to cigarette packs or products.

It should be understood that the above detailed description while indicating preferred embodiments of the invention are given by way of illustration only since various changes and modifications within the spirit and scope of the invention will become apparent to those skilled in the art from the detailed description. For example, the buckle folder may receive coupon segments, each comprising a pair of side-by-side printed coupons. After folding, a longitudinal cutter assembly longitudinally cuts each folded coupon segment into two individual coupons for delivery to cigarette pack overwrap, directly to cigarette packs or to a coupon reservoir.

What is claimed is:

1. A coupon rotation and positioning device comprising:

a coupon folder for folding coupons;

a wheel assembly for accepting coupons from a coupon delivering device, rotating the coupon and delivering the coupon to a substrate;

wherein the wheel assembly has a cam-operated coupon carrier mechanism that includes a coupon carrier with a coupon carrying surface, a positioning arm for positioning the coupon relative to the coupon carrier, and a rotating mechanism for rotating the coupon relative to the coupon carrier, the coupon carrier revolving about a central axis of the wheel assembly, and a plate cam for controlling the positioning arm and the rotating mechanism as the coupon carrier rotates around the central axis of the wheel assembly, wherein the wheel assembly is configured to supply a vacuum for securing the folded coupon against the coupon carrier as the wheel assembly rotates the coupon carrier adjacent to the coupon folder, and wherein the positioning arm is an elongated member provided with a cam follower at one end for interacting with the plate cam and a finger at the end of the positioning arm opposite the cam follower, wherein the positioning arm is capable of pivoting about a pivoting arm axle to thereby extend the finger beyond the coupon carrying surface and adjust the position of the coupon on the coupon carrying surface relative to the rotating mechanism, and wherein the cam follower is maintained in engagement along the outside edge of the plate cam through the use of a compressed spring.

2. The coupon rotation and positioning device of claim 1, wherein the wheel assembly has five coupon carrier mechanisms on the assembly wheel.

3. The coupon rotation and positioning device of claim 1, wherein the positioning arm has two fingers at the end of the positioning arm opposite the cam follower.

4. A coupon rotation and positioning device comprising:

a coupon folder for folding coupons;

a wheel assembly for accepting coupons from a coupon delivering device, rotating the coupon and delivering the coupon to a substrate;

wherein the wheel assembly has a cam-operated coupon carrier mechanism that includes a coupon carrier with a coupon carrying surface, a positioning arm for positioning the coupon relative to the coupon carrier, and a rotating mechanism for rotating the coupon relative to the coupon carrier, the coupon carrier revolving about a central axis of the wheel assembly, and a plate cam for controlling the positioning arm and the rotating mechanism as the coupon carrier rotates around the central axis of the wheel assembly, wherein the wheel assembly is configured to supply a vacuum for securing the folded coupon against the coupon carrier as the wheel assembly rotates the coupon carrier adjacent to the coupon folder, and wherein the positioning arm is an elongated member provided with a cam follower at one end for interacting with the plate cam and fingers at the end of the positioning arm opposite the cam follower, wherein the positioning arm is capable of pivoting about an axle to thereby extend the finder beyond the coupon carrying surface and adjust the position of the coupon on the coupon carrying surface relative to the rotating mechanism; and wherein the wheel assembly is configured to release the vacuum at the surface of the coupon carrier at the point at which the coupon carrier is aligned with a vacuum cowl to allow the coupon to move relative the coupon carrier and align with the positioning fingers and the rotating mechanism.

5. The coupon rotation and positioning device of claim 4, wherein the vacuum cowl is configured to supply a vacuum to a concave surface of the vacuum cowl, said concave surface facing toward the coupon and coupon carrier, the vacuum provided to slow the coupon and allow the positioning fingers to contact the rear edge of the coupon.

6. The coupon rotation and positioning device of claim 5, wherein the wheel assembly is configured to recess the fingers below the coupon carrying surface of the coupon carrier after the coupon has been aligned with the positioning fingers and the rotating mechanism.

7. The coupon rotation and positioning device of claim 6, wherein the coupon carrier is configured to rotate the coupon with the rotating mechanism after the coupon is aligned with the two fingers, the rotating mechanism including a coupon carrying surface, a shaft having a proximal end connected to the coupon carrying surface and a distal end connected to a rack and pinion mechanism, and a cam mechanism for controlling the rack and pinion mechanism, the cam mechanism in contact with the plate cam.

8. The coupon rotation and positioning device of claim 7, wherein the cam mechanism includes a pivoting arm and a cam follower connected to one end of the pivoting arm, the cam follower configured to travel along a cam guide on the cam plate thereby pivoting the pivoting arm about a pivoting axis, and wherein the rack and pinion mechanism includes a rack gear and a pinion gear, the pivoting arm attached to the rack gear to pivot rack gear about the pivoting axis.

9. The coupon rotation and positioning device of claim 7, wherein the plate cam is configured to pivot the rack gear through a 90° oscillation.

10. The coupon rotation and positioning device of claim 4, further comprising a gluing mechanism for applying glue after the coupons have been rotated and before the coupons are delivered to a second substrate.

11. The coupon rotation and positioning device of claim 4, wherein the substrate is a film.

12. The coupon rotation and positioning device of claim 4, wherein the substrate is a cigarette pack.

13. The coupon rotation and positioning device of claim 4, wherein the substrate is a coupon reservoir.

* * * * *